United States Patent [19]

Powaska

[11] 4,058,354

[45] Nov. 15, 1977

[54] STORAGE CONTAINER FOR ROLLS OF TOILET TISSUES

[76] Inventor: Tadeusz Powaska, 166 Adelaide Ave. East, Oshawa, Ontario, Canada

[21] Appl. No.: 596,758

[22] Filed: July 17, 1975

[51] Int. Cl.[2] ..... B65H 19/00; B65G 1/16

[52] U.S. Cl. ..... 312/45; 312/42

[58] Field of Search ..... 312/38, 39, 42, 45, 312/61; 206/806; 229/17 B

[56] References Cited

U.S. PATENT DOCUMENTS

| | | | |
|---|---|---|---|
| 2,037,770 | 4/1936 | Driver | 206/806 |
| 2,042,799 | 6/1936 | Ort | 206/806 |
| 3,216,606 | 11/1965 | Garner | 312/328 |
| 3,300,115 | 1/1967 | Schauer | 229/17 B |
| 3,475,067 | 10/1969 | Girardo | 312/39 |
| 3,529,877 | 9/1970 | Cassidy | 312/39 |
| 3,809,448 | 5/1974 | Rakaska | 312/39 |

*Primary Examiner*—Casmir A. Nunberg

[57] ABSTRACT

A toilet tissue roll container consists of elongated front and rear walls connected between opposed side walls. A pair of end closures are provided to seal the top and bottom of the container. The container is divided into compartments. At least one segment of the front wall is pivotable to provide access to one of the compartments. A pair of end extension flaps are secured to the top wall and are bendable into a plane parallel to said top wall, each of the end extension flaps being provided with means which are cooperable with mating means associated with an external surface for mounting of the container in a predetermined location.

8 Claims, 7 Drawing Figures

STORAGE CONTAINER FOR ROLLS OF TOILET TISSUES

BACKGROUND OF THE INVENTION

The present invention relates to a container for toilet tissue rolls and more particularly to a container which can store a plurality of such rolls for ready availability, the container being mountable easily at a predetermined location.

It has been known heretofore to provide toilet tissue dispensers capable of storing a plurality of rolls of such tissues and constructed so as to prevent the ejection of a roll until substantially all of the tissue is removed therefrom. U.S. Pat. No. 3,580,651 issued May 25, 1971 to Gauper is illustrative of such a holding and dispensing apparatus. There has been need, however, for a storage container for rolls of toilet tissues which is attractive, can easily be mounted in an area of the bathroom which is not otherwise utilized and which is detachably connectable to other bathroom units to form a combination unit.

SUMMARY OF THE INVENTION

It is one object of the invention to provide a storage container for a plurality of rolls of toilet tissue which is combinable with other bathroom units to form a combination unit.

It is another object of the invention to provide a storage container for a plurality of rolls of toilet tissue which can serve as a package for sale and shipment of the rolls therewithin.

It is still another object of the invention to provide a storage container for a plurality of rolls of toilet tissues which can be mounted readily at any predetermined location and is sufficiently inexpensive so as to be disposable when the last roll of toilet tissue stored therein has been removed.

Other objects and advantages of the invention will become readily apparent from the following description of the invention.

According to the present invention there is provided a toilet tissue roll storage container, comprising a pair of elongated spaced parallel side walls, a rear wall connected between said side walls, a front wall connected between said side walls in opposed relation to said rear wall, and top and bottom end closures, at least one pivotable closure member forming a section of said front wall pivotable to provide access to the interior of the container, a pair of extension flaps being secured at their respective bases to the top of the container, each of said flaps being bendable between a plane parallel to the top wall of the container and an extended position and having means thereon cooperable with mating means associated with an external surface for mounting of said container in a predetermined location.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
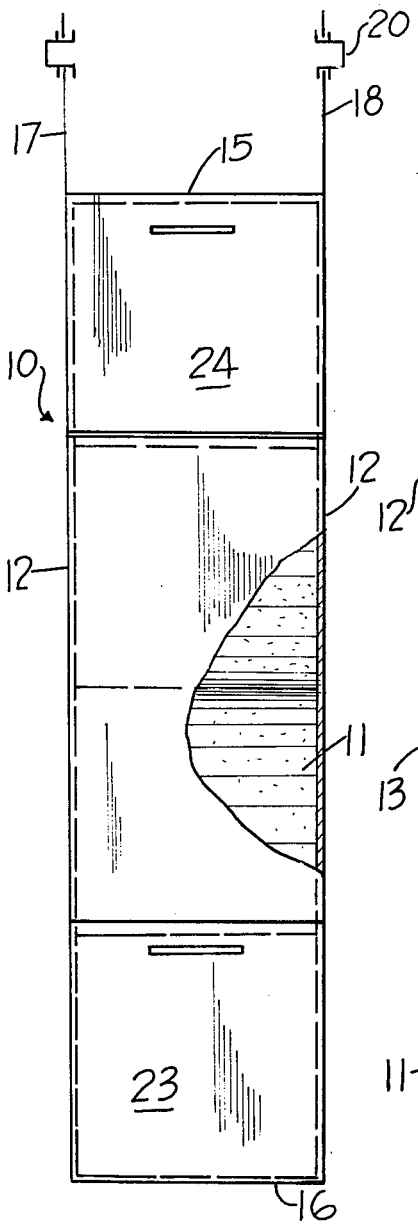
FIG. 1 is a front view, partly broken away, of the storage container of this invention.
Figure 2:
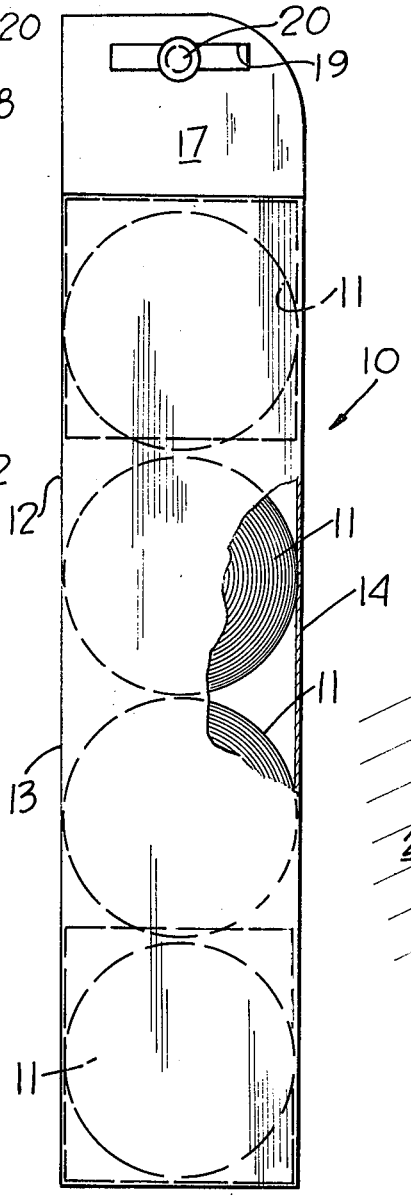
FIG. 2 is a side view, partly broken away, of the storage container shown in FIG. 1.
Figure 4:
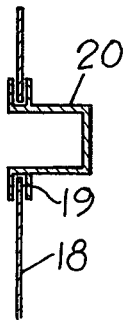
FIG. 4 is a cross-sectional view taken along A—A of FIG. 3.
Figure 3:
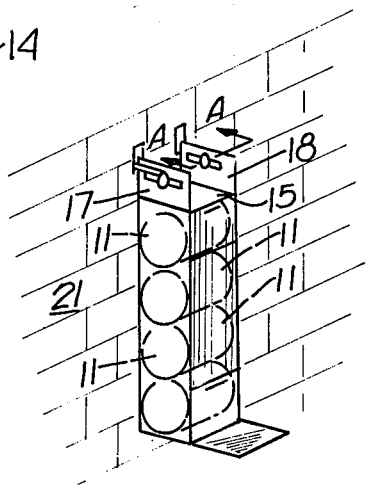
FIG. 3 is a front perspective view of a toilet tissue roll storage container embodying the invention and mounted on a bathroom wall.
Figure 5:
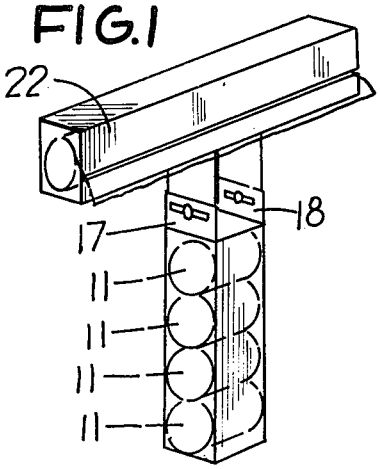
FIG. 5 is a front perspective view of a toilet tissue roll storage container embodying the invention combined into a unit with another bathroom unit.
Figure 6:
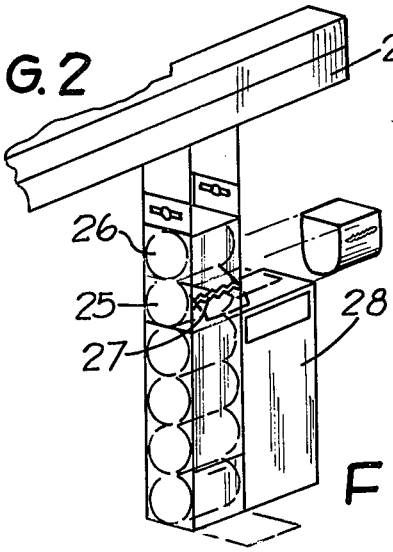
FIG. 6 is a further embodiment of the invention shown in perspective.

Referring to FIGS. 1 and 2 of the drawings there is shown a storage container 10 containing therein a plurality of rolls 11 of toilet tissues. The container is formed by a pair of elongated spaced parallel side walls 12, a rear wall 13 connected between the side walls, a front wall 14 connected between the side walls in spaced relation to said rear wall and a pair of top and bottom end closures 15, 16. At the top of the container there is provided a pair of extension flaps 17, 18 which are bendable about their respective base lines at which areas they are secured to the top of the container. The flaps are bendable between a stored position in which they lie in a plane which is parallel to the plane of the top wall and an extended position as shown in all of the figures. In their extended position the flaps effectively become extensions of the side walls. Each of the flaps are provided with means such as slots 19 cooperable with mating means 20 located on an external surface such as a bathroom wall 21 or a lower portion of a paper towel dispenser 22 so that the container 10 may be mounted in a predetermined location. As shown, for example, in FIG. 3 the container 10 is mounted directly on the wall 21 of the bathroom. FIGS. 5 and 6 illustrate the container as occupying a normally vacant and under-utilized area of a bathroom wall beneath the paper towel dispenser.

A particular advantage of providing the container with flap extensions 17, 18 is that the container can be used for packaging of a plurality of toilet tissue rolls and for their shipment within the container for sale. Once purchased and transported to the home of the purchaser the flap extensions, until then in their folded position adjacent the top wall of the container, are extended for mounting in the desired location.

It will be appreciated, of course, that the form of cooperable means 19, 20 is not critical nor is it essential that the female element be provided on the flap whereas the male element be located on the external surface.

The container is essentially divided into a plurality of compartments. Preferably there are six to eight of such compartments. Each of such compartments is dimensioned to accommodate a roll of toilet tissues. An access door 23 is positioned over preferably the lowermost compartment and allows the user to withdraw one of the stored rolls from within the container. Where desired another access door 24 may be provided for the refilling of the container when the original supply of rolls of toilet tissues is exhausted. Such access doors are preferably pivotable about their upper or lower marginal edges to facilitate their use. If desired, a portion of or all of the front wall may be formed of a material which is transparent or transluscent so that the user may have a visual indication of the supply of rolls remaining within the container.

Figure 7:
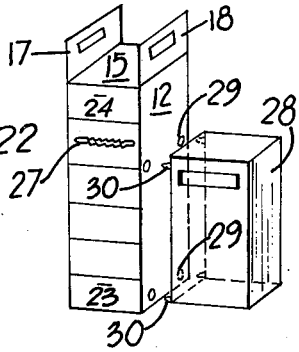
FIG. 7 is a perspective view of a storage container incorporating the features of the invention showing means for detachably securing same to an adjacent bathroom unit.

Referring to FIGS. 6 and 7 it will be seen that a dispenser for wet towels 25 and a storage compartment 26 for wet towels may be provided within the container as the upper compartments. In such instance the front wall of the compartment intended for use as the dispensing compartment is provided with a serrated opening 27. Thus, the wet towels may be serially withdrawn from the dispenser and torn off for use. The upper compartment is desirably given a door 24 for restocking the dispensing compartment. It will be understood, of course, that one of the advantages of this invention resides in the adaptability of the container for combination with other bathroom units. Therefore, the wet towel dispenser can be a separate and distinct unit which can be added to the storage container 10. For example, a recess between the top wall 15 and a lower compartment can be provided within which the wet towel dispenser may slide into and out of position. A retaining flange (not shown) may be formed on the container 10 to guide the wet towel dispenser into its proper position.

There is also shown in FIGS. 6 and 7 a waste basket or receptacle 28 which is connectable detachably with container 10 to form a single combination unit. Connecting or coupling means such as apertures 29 and dowels 30 are provided on the contiguous surfaces of the container and waste receptacle for ready assembly and disassembly of such units.

From the foregoing it will be seen that the invention affords a storage container or tissue sleeve for the storage of a plurality of rolls of toilet tissues in an attractive container which may be fabricated from a relatively inexpensive material and may thus be disposable once the supply of rolls stored therewithin is exhausted. It also makes available a bathroom unit which can readily be combined with other units customarily hung or otherwise located in a bathroom.

What is claimed is:

1. A toilet tissue roll storage container, comprising a pair of elongated spaced parallel side walls, a rear wall connected between said side walls, a front wall connected between said side walls in opposed relation to said rear wall, and top and bottom end closures, at least one pivotable closure member forming a section of said front wall pivotable to provide access to the interior of the container, a pair of integrally formed extension flaps secured at their respective bases to the top of the container, each of said flaps being bendable between a plane parallel to the top wall of the container and an extended vertical position and having means thereon cooperable with mating means associated with an external surface for mounting of said container in a predetermined location.

2. A storage container according to claim 1, wherein the walls thereof are dimensioned in length so as to provide from four to eight compartments of substantially equal length, said pivotable closure member being pivotable to provide access to one of said compartments.

3. A storage container according to claim 2, wherein said pivotable closure member is secured pivotably so as to provide access to the lowermost of said compartments.

4. A storage container according to claim 2, wherein one of the upper compartments is provided in the front wall thereof with a serrated opening for the withdrawal therefrom of wet towels.

5. A storage container according to claim 4, wherein said one upper compartment for the dispensing of wet towels is removable from the storage container, said storage container being provided with a recess therein dimensioned to receive said compartment, a retaining flange being formed on the container for guiding said dispensing compartment into proper position within the storage container.

6. A storage container according to claim 2, wherein the uppermost compartment is provided with a pivotable closure member for gaining access to the interior thereof.

7. A storage container according to claim 1, wherein at least one of said side walls is provided with first securing means cooperable with second securing means carried by a waste container whereby said waste container may be detachably affixed to said toilet tissue container to form a combination unit therewith.

8. A storage container according to claim 1, wherein at least one of said front and side walls is formed at least partially of a material through which one can see to determine the number of toilet tissue rolls stored therewithin.

* * * * *